US010233734B2

(12) United States Patent
Greci et al.

(10) Patent No.: US 10,233,734 B2
(45) Date of Patent: Mar. 19, 2019

(54) WELL SCREEN ASSEMBLY INCLUDING AN EROSION RESISTANT SCREEN SECTION

(71) Applicant: Halliburton Energy Services, Inc., Houston, TX (US)

(72) Inventors: Stephen Michael Greci, Little Elm, TX (US); Brandon Thomas Least, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 411 days.

(21) Appl. No.: 14/904,524

(22) PCT Filed: Dec. 31, 2013

(86) PCT No.: PCT/US2013/078451
§ 371 (c)(1),
(2) Date: Jan. 12, 2016

(87) PCT Pub. No.: WO2015/195068
PCT Pub. Date: Dec. 23, 2015

(65) Prior Publication Data

US 2016/0160615 A1 Jun. 9, 2016

(51) Int. Cl.
*E21B 43/04* (2006.01)
*E21B 43/08* (2006.01)

(52) U.S. Cl.
CPC ..... *E21B 43/08* (2013.01); *E21B 43/04* (2013.01); *E21B 43/045* (2013.01)

(58) Field of Classification Search
CPC ..... E21B 43/04; E21B 43/045; E21B 43/08
See application file for complete search history.

(56) References Cited

U.S. PATENT DOCUMENTS

| | | | | |
|---|---|---|---|---|
| 5,829,522 | A | 11/1998 | Ross et al. | |
| 5,881,809 | A * | 3/1999 | Gillespie | B01D 29/15 166/233 |
| 8,763,689 | B2 * | 7/2014 | Heijnen | E21B 34/14 166/205 |
| 9,725,989 | B2 * | 8/2017 | Mayer | E21B 43/08 |
| 2002/0157836 | A1 | 10/2002 | Royer et al. | |
| 2003/0000875 | A1 | 1/2003 | Echols et al. | |
| 2013/0206406 | A1 | 8/2013 | Kuo et al. | |

FOREIGN PATENT DOCUMENTS

| | | | |
|---|---|---|---|
| WO | 2004099560 | A1 | 11/2004 |
| WO | 2015195068 | A2 | 12/2015 |

OTHER PUBLICATIONS

International Search Report and Written Opinion for PCT/US2013/078451 dated Dec. 10, 2015.

* cited by examiner

*Primary Examiner* — Matthew R Buck
(74) *Attorney, Agent, or Firm* — McGuireWoods LLP

(57) ABSTRACT

An assembly, comprising a production tubing having at least one flow port defined therein; a well screen arranged about the production tubing and in fluid communication with the at least one flow port; and an erosion resistant screen section arranged about the production tubing uphole from the well screen and in fluid communication with the at least one flow port.

22 Claims, 3 Drawing Sheets

WELL SCREEN ASSEMBLY INCLUDING AN EROSION RESISTANT SCREEN SECTION

BACKGROUND

The present disclosure generally relates to well screen assemblies used in the oil and gas industry and, more specifically, to well screen assemblies that include an erosion resistant screen section for use in gravel packing or frac-packing operations.

In hydrocarbon-producing wells, loosely or unconsolidated portions of a subterranean formation (e.g., sand, rock, or other particulates) may be produced with formation fluids. These unconsolidated particulates may adversely affect production equipment and operations, increasing expense and operator and/or wellbore downtime. For example, production of the unconsolidated particulates may result in, among other things, severe erosion of wellbore tubulars (e.g., production tubing) and partial or complete blockage of the flow of formation fluids for recovery. Producing unconsolidated particulates often requires costly workover jobs, and can sometimes lead to caving or collapse of casing sections.

One approach to prevent or reduce the unconsolidated particulates from being produced with the formation fluids is the use of a gravel packing or frac-packing treatment. In a typical gravel packing treatment, one or more screens are mounted on a wellbore tubular and positioned in a wellbore drilled through a subterranean formation adjacent a desired production interval. An annulus is formed between the subterranean formation and the wellbore tubular. Specifically sized particulate material, referred to herein collectively as "gravel," is pumped as a slurry through the wellbore tubular and into the annulus. Some of the liquid in the slurry flows through the screens and into the wellbore tubular at one or more flow ports provided in the wellbore tubular. A portion of the liquid may also flow into the subterranean formation for treatment operations (e.g., hydraulic fracturing, etc.). The gravel is deposited into the annulus around the screen and tightly packed therein to form a "gravel pack." The gravel is sized such that it forms a permeable mass that allows formation fluids therethrough but at least partially prevents or blocks the flow of unconsolidated particulates with the formation fluids.

As used herein, the term "frac-packing" refers to a combined hydraulic fracturing and gravel packing treatment. In a typical frac-packing treatment, a fluid is pumped through the annulus between a wellbore tubular mounted with a well screen and a wellbore in a subterranean formation. The fluid includes particulate matter, such as proppant and/or gravel, and is pumped into various perforations that have been defined through casing that lines the wellbore. In the case of open hole completions, the fluid slurry is pumped directly into the wellbore perforations. The fluid slurry is pumped at a rate and pressure sufficient to create or enhance at least one fracture in the surrounding formation, and the proppant and/or gravel is flowed into the created fractures and serves to keep them open during production.

Once a desired amount of hydraulic fracturing in the formation has been achieved, fluids are then drawn through the well screens to be returned to the surface. This process causes the gravel to dehydrate and pack against the well screens. The fluids will tend to follow the path of least resistance, which causes the liquid to flow to the screen sections not covered in gravel, which are typically the upper portions of the well screens. The decrease in flow area through the well screen increases the fluid velocity and pressure. As the gravel covers the last bit of the well screen, commonly referred to as "screen out," the pressure spikes and pumping is stopped. This increase in fluid velocity and pressure at screen out can result in the remaining portions of the screens that are not covered in gravel to experience erosion or deformation that may result in screen failure. Screen failure may result in gravel from the gravel pack and/or other formation unconsolidated particulates being produced to the surface.

To reduce the possibility of screen failure, the rate of return through the screens when forming the gravel pack is typically reduced or otherwise limited. However, limited return rates may result in, among other things, a longer period before the well can be brought on and a greater amount of fluid required in the slurry.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure generally relates to downhole screen assemblies used in the oil and gas industry and, more specifically, to screen assemblies that include an erosion resistant screen section for use in gravel packing or frac-packing operations.

Disclosed are various embodiments of a well screen assembly including an erosion resistant screen section that may be mounted onto a base pipe above the upper portions, or otherwise uphole, of a well screen. The embodiments herein permit gravel packing and frac-packing treatments to be performed at high rates of return, such as above 2 barrels per minute ("BPM"), by preventing or reducing the possibility of screen failure. The placement of the erosion resistant screen section uphole from the well screen permits the high volume, velocity, and pressure liquid in a gravel slurry to pass into the base pipe through the erosion resistant screen section just prior to screen-out as a gravel pack is progressively formed. As will be appreciated, this will avoid drawing the high pressure and velocity liquid through the uphole portions of the well screens, which is less adequate at resisting erosion and thereby more prone to failure, due to the progressively reduced flow area through the screen.

Figure 1:
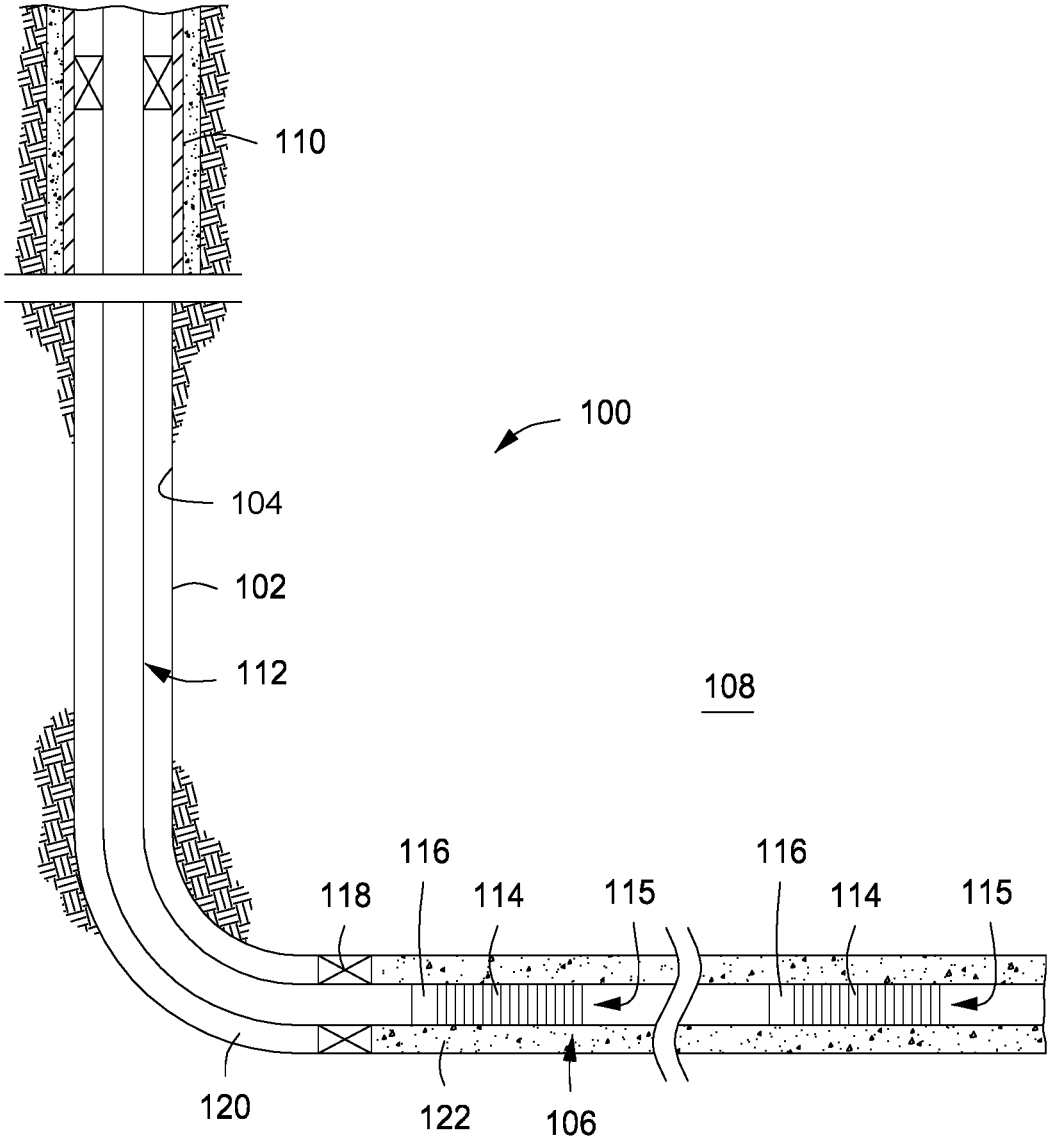
FIG. 1 illustrates a well system that can exemplify the principles of the present disclosure, according to one or more embodiments described herein.

Referring to FIG. 1, illustrated is a well system 100 that exemplifies principles of the present disclosure, according to one or more embodiments. As illustrated, the well system 100 may include a wellbore 102 that has a generally vertical uncased section 104 that transitions into a generally uncased horizontal section 106 extending through a subterranean formation 108. In some embodiments, the vertical uncased section 104 may extend downwardly from a portion of the wellbore 102 having a casing string 110 cemented therein. An elongate tubular base pipe, such as production tubing 112, may be installed or otherwise extended into the wellbore 102.

One or more well screen assemblies 115 may be arranged about the production tubing 112. As illustrated, each well screen assembly 115 may include one or more well screens 114 arranged about the production tubing 112 and one or more erosion resistant screen sections 116 arranged uphole from the well screens 114. In the illustrated embodiment, erosion resistant screen sections 116 are depicted as being arranged on each well screen 114. However, those skilled in the art will readily appreciate that, in some embodiments, the erosion resistant screen section 116 may only be needed and otherwise arranged at the uphole end of the uppermost well screen 114, without departing from the scope of the disclosure. In some embodiments, one or more packers 118 or other wellbore isolation devices may be disposed about the production tubing 112, such as along portions of the production tubing 112 in the horizontal uncased section 106 of the wellbore 102. An annulus 120 may be defined between the exterior of the production tubing 112 and the walls of the wellbore 102, and the packer(s) 118 may be configured to isolate portions of the annulus 120 for gravel packing operations and/or production or injection operations.

The well screens 114 and the erosion resistant screen sections 116 may be in fluid communication with the interior of the production tubing 112 through one or more flow ports (not shown) defined in the production tubing 112. In preparation for production or stimulation operations, the annulus 120 may be packed with gravel 122 conveyed into the annulus 120 in a gravel slurry that comprises gravel, sand, and other particulate materials suspended in a fluid. The well screen 114 and the erosion resistant screen section 116 may be configured to draw in portions of the fluid from the gravel slurry as the gravel 122 is deposited into the annulus 120 to form a gravel pack. After placement of the gravel 122 and formation of the gravel pack, the well screen assembly 115 (i.e., the well screen 114 and the erosion resistant screen section 116) and the gravel 122 may cooperatively facilitate communication of fluids from surrounding subterranean formation 108 and into the production tubing 112 through the flow ports. The gravel 122 packed into the annulus 120 may provide a first stage of filtration against the passage of particulate or larger fragments of the formation 108 into the production tubing 112. The well screen assembly 115 may be configured to provide a second stage of filtration against the passage of particulates or fragments of the formation 108 of a specified size and larger into the production tubing 112.

It will be appreciated by one of skill in the art that the well system 100 of FIG. 1 is merely one example of a wide variety of well systems in which the principles of the present disclosure may be utilized. Accordingly, it will be appreciated that the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical uncased section 104 or a general horizontal uncased section 106. The well system 100 may equally be employed in vertical and/or deviated wellbores, without departing from the scope of the disclosure. Furthermore, it is not necessary for a single erosion resistant screen section 116 to be used in conjunction with a single well screen 114.

In addition, it is not necessary for the well screens 114, erosion resistant screen sections 116, packers 118, or any other components of the production tubing 112 to be positioned in vertical uncased section 104 or horizontal uncased section 106 of the wellbore 102. Rather, any section of the wellbore 102 may be cased or uncased, and any portion of the production tubing 112 may be positioned in an uncased or cased section of the wellbore 102, without departing from the scope of the disclosure.

Figure 2A:
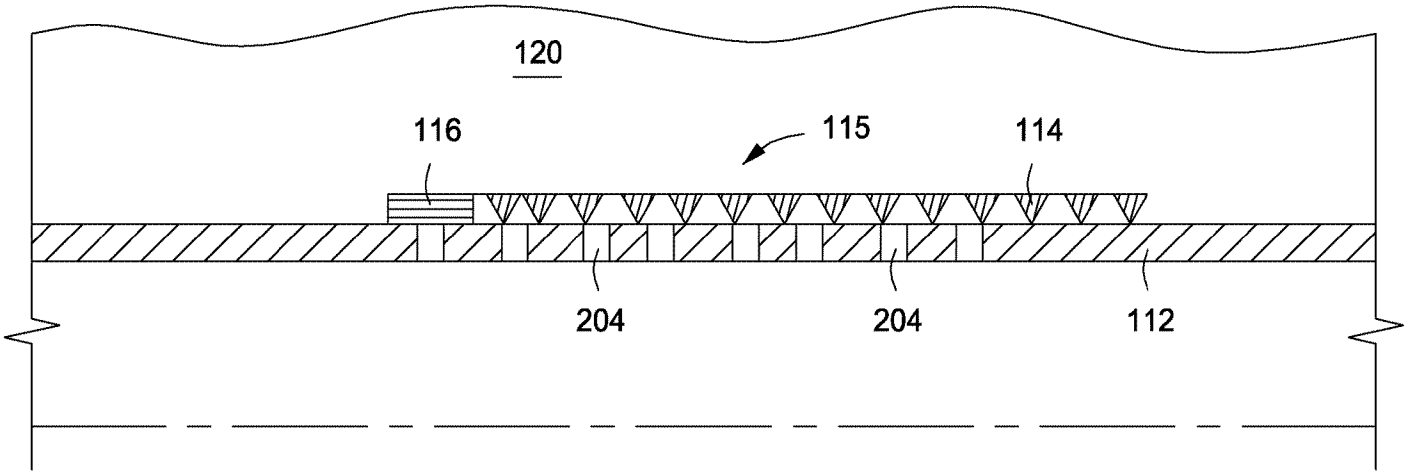
FIGS. 2A-2B illustrate a cross-sectional view of a portion of a well screen assembly including an exemplary erosion resistant screen section, according to one or more embodiments of the present disclosure.
Figure 2B:
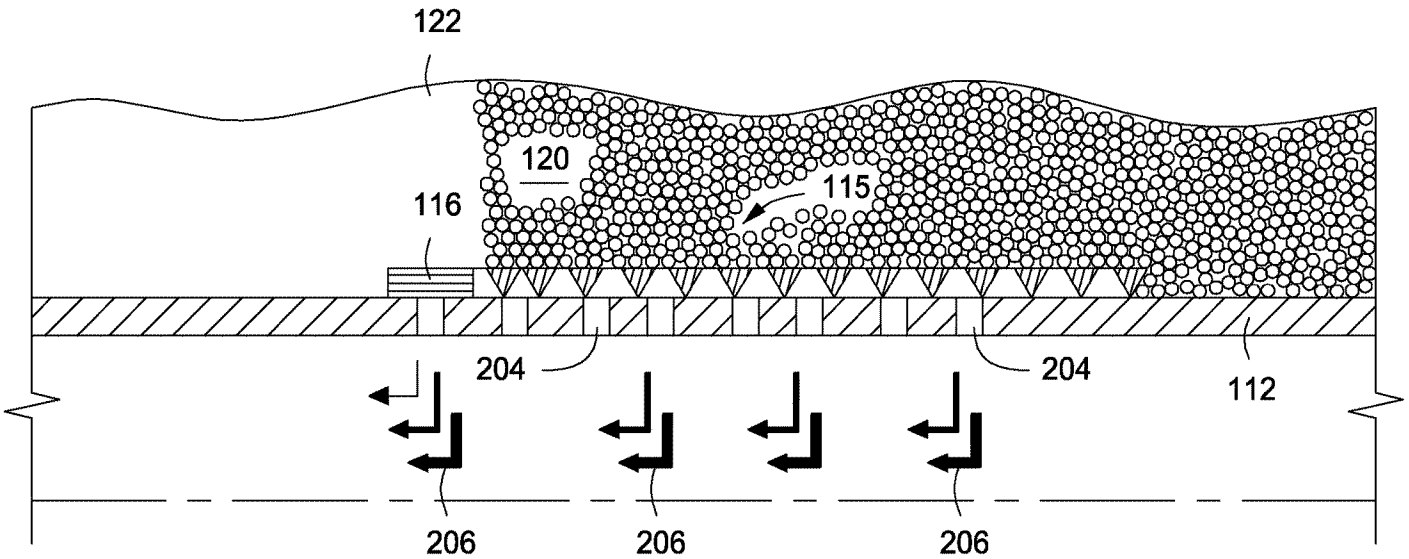

Referring now to FIGS. 2A-2B, with continued reference to FIG. 1, illustrated is an enlarged cross-sectional view of a portion of one of the well screen assemblies 115, according to one or more embodiments of the present disclosure. As illustrated, the production tubing 112 may include a plurality of flow ports 204 at predetermined or various locations along the axial length thereof, and therefore may be generally characterized as a perforated base pipe. The flow ports 204 may allow communication of fluids between the annulus 120 and the interior of the production tubing 112, such as, for example, during a gravel packing operation or a frac-packing operation or during any other downhole operation.

The well screen assembly 115 may be arranged about the exterior of the production tubing 112 such that the well screen 114 and the erosion resistant screen section 116 substantially cover and otherwise axially traverse some or all of the flow ports 204. As illustrated, the erosion resistant screen section 116 is positioned uphole (i.e., to the left in FIGS. 2A and 2B) from the well screen 114 and also arranged about the production tubing 112. In some embodiments, the well screen 114 and the erosion resistant screen section 116 may be coupled together to form the well screen assembly 115. For instance, in at least one embodiment, the well screen 114 and the erosion resistant screen section 116 may be coupled together with a shroud or sleeve (not shown) that spans an axial distance between the two components.

In other embodiments, the well screen 114 and the erosion resistant screen section 116 may be unattached and otherwise not coupled together. For example, the erosion resistant screen section 116 may be axially-offset a short distance uphole from the well screen 114 such that neither are in physical contact with one another or otherwise coupled using a shroud or the like. It will be appreciated by one of skill in the art, that the distance between the erosion resistant screen section 116 and the well screen 114, whether the two components are in contact with one another or not, may be any distance suitable for use in a desired subterranean formation operation.

Although only a single erosion resistant screen section 116 is illustrated in FIGS. 2A-2B, multiple erosion resistant screen section may be employed, without departing from the scope of the present disclosure. Moreover, while not shown in FIGS. 2A-2B, it will be appreciated that one or more additional well screens 114 may be included in the well screen assembly 115 and otherwise arranged further downhole from the erosion resistant screen section 116.

The well screen 114 may be characterized as a filter medium designed to allow fluids to flow therethrough but generally prevent the influx of particulate matter of a predetermined size. In some embodiments, the well screen 114 may be a fluid-porous, particulate restricting device made from a plurality of layers of a wire mesh that are diffusion bonded or sintered together to form a fluid porous wire mesh screen. In other embodiments, however, the well screen 114 may have multiple layers of a weave mesh wire material having a uniform pore structure and a controlled pore size that is determined based upon the properties of the formation 108. For example, suitable weave mesh screens may include, but are not limited to, a plain Dutch weave, a twilled Dutch weave, a reverse Dutch weave, combinations thereof, or the like. In other embodiments, however, the well screen 114 may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other mesh designs are equally suitable, without departing from the scope of the disclosure.

Accordingly, the well screen 114 may be a wire wrap screen, a swell screen, a sintered metal mesh screen, an expandable screen, a pre-packed screen, a treating screen, or any other type of sand control screen known to those of skill in the art. In some embodiments, the well screen 114 may additionally include a drainage layer and/or an outer protective shroud. Moreover, in some embodiments, the well screen 114 may have a mesh layer disposed about the outer perimeter thereof.

The erosion resistant screen section 116, like the well screen 114, may act as a filter medium designed to allow fluids to flow therethrough but generally prevent the influx of particulate matter of a predetermined size. In some embodiments, the erosion resistant screen section 116 may include one or more substantially annular or arcuate rings disposed about the production tubing 112 and axially offset from each other by very small or minute distances or offsets. The axial offset between adjacent rings may allow fluids to pass therethrough, but generally prevent particulate matter larger than the axial offsets from traversing the erosion resistant screen section 116. In at least one embodiment, for example, the erosion resistant screen section 116 may be a PETROCERAM® sand screen, commercially-available from Ceradyne, Inc.

In some embodiments, the annular rings forming the erosion resistant screen section 116 may be tapered or otherwise shaped to allow fluid flow while preventing the influx of particulate matter into the interior of the production tubing 112. The annular rings may be carbide rings or disks. In other embodiments, the erosion resistant screen section 116 may include or otherwise define one or more radial flow channels therethrough that facilitate fluid communication between the annulus 120 and at least one of the flow ports 204. In still other embodiments, at least a portion of the erosion resistant screen section 116 may include porous ceramic, carbide disks or rings, and/or hardened steel wires.

As illustrated, the erosion resistant screen section 116 may exhibit a length that is smaller or shorter than the length of the well screens 114. Because the erosion resistant screen sections 116 are formed from materials that are capable of withstanding the stresses of the gravel slurry during a gravel packing or frac-packing operation, their size can be relatively reduced without compromising the integrity of the screen assembly 115.

The erosion resistant screen section 116 may be made of any erosion resistant material suitable for use in subterranean environments and otherwise capable of withstanding the stresses placed on screens during downhole operations, such as gravel packing or frac-packing operations. Suitable erosion resistant materials for at least partially forming the erosion resistant screen sections 116 may include, but are not limited to, a ceramic, a hardened metal, a carbide, a polymeric compound, and any combination thereof. The erosion resistant screen sections 116 may themselves be formed from the erosion resistant materials described according to one or more embodiments herein, or may be at least partially formed from the erosion resistant materials, such as by first molding any other material and thereafter coating the mold by any method known to those of skill in the art with one or more of the erosion resistant materials described herein. In some embodiments, a material (e.g., a stainless steel, a plastic, and the like) may be coated with a ceramic, a hardened metal, or a polymeric compound alone, for example. In other embodiments, a material (e.g., a stainless steel, a plastic, and the like) may be coated with a ceramic and a hardened metal, in any order or configuration, or a ceramic and a polymeric compound, in any order or configuration. In other embodiments, a material (e.g., a stainless steel, a plastic, and the like) may be coated with a hardened metal and a polymeric compound, in any order or configuration. In yet other embodiments, a material (e.g., a stainless steel, a plastic, and the like) may be coated with a ceramic, a hardened metal, and a polymeric compound, in any order or configuration. One of skill in the art, with the benefit of this disclosure, will recognize what type of erosion resistant material to use or to coat onto another material, including whether multiple coating types may be preferred, depending on, at least, the type and conditions of the desired subterranean formation operation.

Suitable ceramics for use in forming the erosion resistant screen sections 116 may include, but are not limited to, an oxide ceramic, a boride ceramic, a nitride ceramic, a silicate ceramic, a ceramic composite material, and any combination thereof. Suitable oxide ceramics may include, but are not limited to, silicon oxide, silicon dioxide, aluminum oxide, aluminum titanate, beryllium oxide, zirconium oxide, magnesium oxide, titanium dioxide, lead zirconium titanate, and any combination thereof (e.g., aluminum oxide reinforced with zirconium oxide). Suitable boride ceramics may include, but are not limited to, titanium diboride, zirconium diboride, hafnium diboride, and any combination thereof. Suitable nitride ceramics may include, but are not limited to, silicon nitride, aluminum nitride, boron nitride, titanium nitride, zirconium nitride, vanadium nitride, niobium nitride, tantalum nitride, hafnium nitride, and any combination thereof. Suitable silicate ceramics may include, but are not limited to, porcelain, steatite, cordierite, mullite, and any combination thereof. Suitable composite materials may include, but are not limited to, any ceramic material reinforced with a particulate, a fiber, a metal (e.g., aluminum, magnesium, titanium, and the like), and any combination thereof.

Suitable hardened metals for use in forming the erosion resistant screen sections 116 may be any hardened metal capable of use in downhole environments and otherwise able to withstand the pressures placed on the screen section during downhole operations, such as gravel packing and frac-packing operations. Suitable hardened metals may include, but are not limited to, hardened steel.

Suitable carbides may include, but are not limited to, silicon carbide, boron carbide, tungsten carbide, vanadium carbide, hafnium carbide, tantalum carbide, zirconium carbide, titanium carbide, niobium carbide, chromium carbide, molybdenum carbide, and any combination thereof.

Suitable polymeric compounds may include, but are not limited to, a polyimide, a polyamide, a polyketone, a polyetherketone, a polysulfone, a polycarbonate, a polystyrene, a polyvinyl chloride, a polypropylene, a polyetherketone, a polyethersulfone, a polyethylene terephthalate, a polyethylene, a polyester, a polyesteramide, a polyvinyl formal, a polyvinyl alcohol, a polytetrafluoroethylene, a polyamine (e.g., a nylon), a polyacrylate (e.g., polymethylacrylate), a polyurethane, a fluoroethylene/propylene copolymer, a vinyl chloride/vinylidene chloride copolymer, a vinyl chloride/vinyl acetate copolymer, a butadiene/styrene copolymer, a cellulose, a triacetate, a silicone, a rubber, and any copolymers thereof, any terpolymers thereof, and any combination thereof.

Referring now to FIG. 2B, exemplary operation of the well screen assembly 115 is provided. A gravel slurry comprising a fluid 206 and gravel 122 may be introduced into the annulus 120 and gradually built up from the bottom of the wellbore (i.e., from the right in FIGS. 2A and 2B) and toward the top (i.e., toward the left in FIGS. 2A and 2B). More particularly, as the gravel slurry is introduced into the annulus 120, the gravel 122 is first deposited downhole of the well screen assembly 115 and progressively builds in the uphole direction toward the erosion resistant screen section 116 to form a gravel pack.

As the gravel 122 is deposited, at least a portion of the fluid 206 is drawn through the well screen assembly 115 and into the interior of the production tubing 112 through the various flow ports 204. The circulating fluid 206 naturally follows the path of least resistance through the well screen assembly 115. As a result, the majority of the fluid 206 will tend to pass through the well screen assembly 115 uphole from portions of the annulus 120 where the gravel 122 has already been placed. That is, only a small portion of the fluid 206 will pass through portions of the well assembly 115 where the gravel 122 has already been packed.

As the gravel 122 is deposited within the annulus 120, and the resulting gravel pack progressively builds in the uphole direction across the well screen assembly 115, the velocity and pressure of the fluid 206 and small particulate matter being forced through the well screen 114 correspondingly increases. Moreover, as the progressively building gravel pack approaches the uphole end of the well screen 114, and just prior to screen-out, the increased volume, velocity, and pressure of the fluid 206 and small particulate matter flowing through the well screen 114 can reach a critical threshold that could damage the well screen 114 through erosion.

According to the present disclosure, however, placement and use of the erosion resistant screen section 116 uphole from the well screen 114 may mitigate and otherwise prevent erosion effects of the fluid 206 on the well screen assembly 115. More particularly, the greatest volume, velocity, and pressure of the fluid 206, and any small particulate matter suspended therein, will be forced through the erosion resistant screen section 116 just prior to screen-out. Since the erosion resistant screen section 116 is particularly and specifically designed to better withstand erosion than the well screen 114, little to no damage to the well screen assembly 115 may be assumed during the gravel packing process.

Figure 3A:
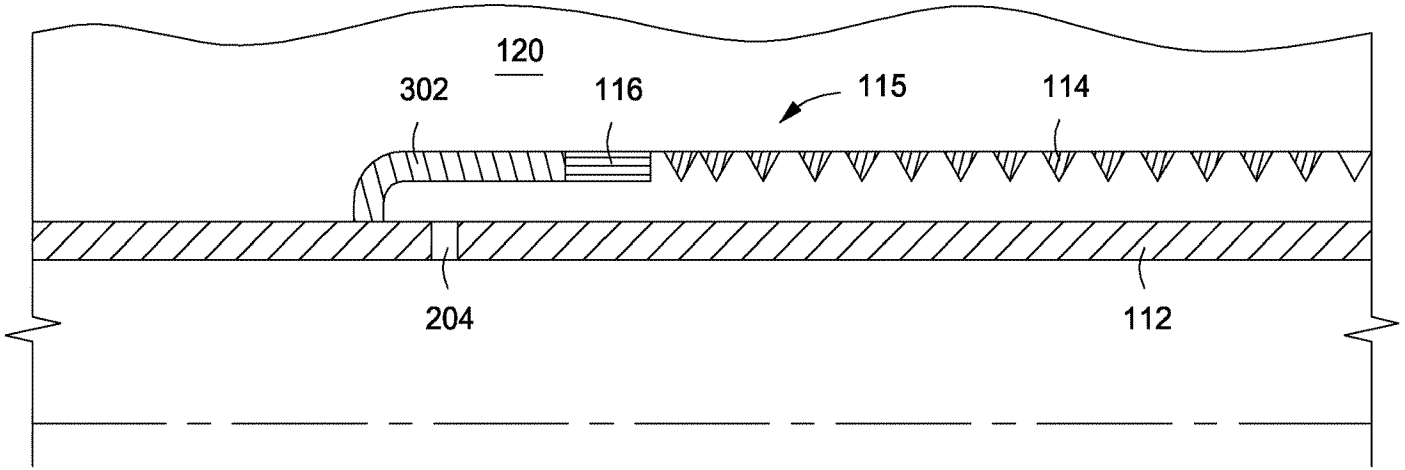
FIGS. 3A-3B illustrate a cross-sectional view of a portion of a well screen assembly including an exemplary erosion resistant screen section, according to one or more embodiments of the present disclosure.
Figure 3B:
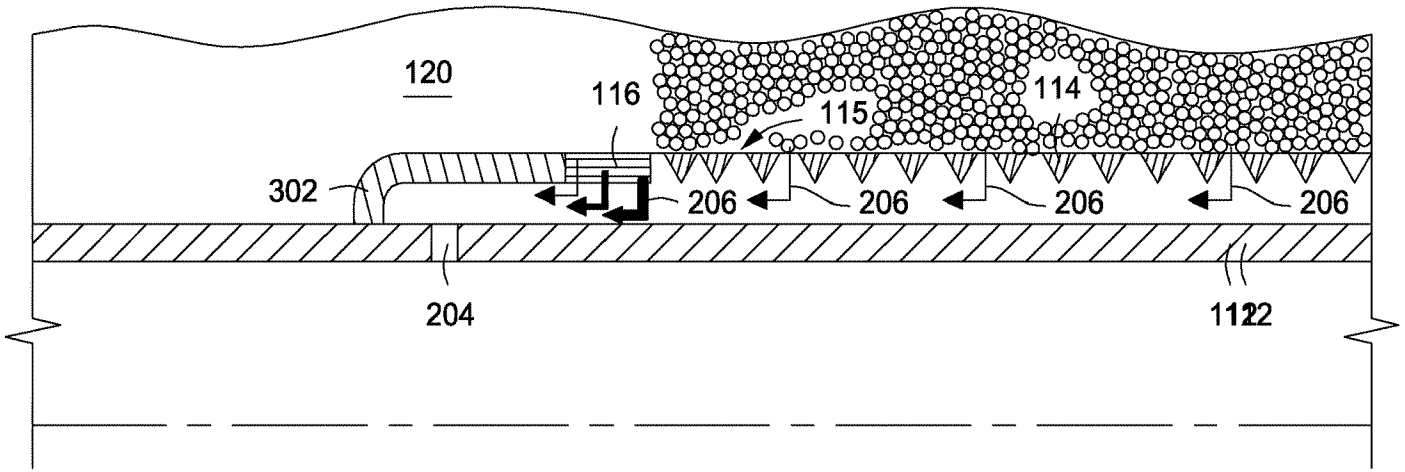

Referring now to FIGS. 3A-3B, with continued reference to FIGS. 1 and 2A-2B, illustrated is another enlarged cross-sectional view of a portion of one of the well screen assemblies 115 of FIG. 1, according to one or more embodiments. The well screen assembly 115 depicted in FIGS. 3A-3B may be substantially similar to the well screen assembly 115 of FIGS. 2A and 2B and, therefore, may be best understood with reference thereto, where like numerals refer to like elements not described again in detail.

As illustrated, the production tubing 112 may have one or more flow ports 204 defined therein and axially offset from the well screen 114 and the erosion resistant screen section 116. The well screen assembly 115 may include an end ring 302 coupled or otherwise attached to the production tubing and generally extending over the flow port(s) 204 therein. The end ring 302 may be coupled to the production tubing 112 through, for example, welding, brazing, adhesives, mechanical fasteners, or any combination thereof. The erosion resistant screen section 116 and the well screen 114 may extend axially downhole from the end ring 302. More particularly, in at least one embodiment, the erosion resistant screen section 116 may be coupled to the end ring 302 and otherwise interpose the well screen 114 and the end ring 302.

The well screen 114 and the erosion resistant screen section 116 may be radially offset from the production tubing 112, such that fluids 206 are drawn in radially through the well screen 114 and the erosion resistant screen section 116 and then axially flow uphole until locating the flow port(s) 204. As will be appreciated by one of skill in the art, the production tubing 112 may have one or more additional flow ports (not shown) at any location along the axial length of the production tubing 112 such that fluid 206 may be filtered through the well screen assembly 115 and into the interior of the production tubing 112 without also allowing the gravel 122 to flow therethrough. That is, one or more additional flow ports 204 may be located in the production tubing 112 radially adjacent the well screen assembly 115 at any location, without departing from the scope of the disclosure.

Similar to the embodiment depicted in FIGS. 2A-2B, the well screen 114 and the erosion resistant screen section 116 in FIGS. 3A-3B are arranged about the production tubing 112, and the erosion resistant screen section 116 is positioned uphole from the well screen 114. In some embodiments, as generally described above, the erosion resistant screen section 116 may be axially offset a small distance from the well screen 114 and otherwise coupled together using a shroud or a sleeve. In other embodiments, however, the erosion resistant screen section 116 may be directly coupled to the well screen 114, without departing from the scope of the disclosure.

Referring specifically to FIG. 3B, the gravel slurry comprising the fluid 206 and gravel 122 is introduced into the annulus 120 and gradually built up from the bottom of the wellbore (i.e., from the right in FIGS. 3A and 3B) and toward the top of the wellbore (i.e., toward the left in FIGS. 3A and 3B). The gravel 122 progressively builds in the uphole direction toward the erosion resistant screen section 116 to form the gravel pack. As the gravel 122 is progressively deposited, at least a portion of the fluid 206 is drawn through the well screen 114 and conveyed axially toward the flow port(s) 204. Since the fluid 206 naturally follows the path of least resistance, the majority of the fluid 206 will tend to pass through the well screen assembly 115 uphole from portions of the annulus 120 where the gravel 122 has already been placed.

Accordingly, as the gravel 122 is deposited within the annulus 120, and the resulting gravel pack progressively builds in the uphole direction across the well screen assembly 115, the velocity and pressure of the fluid 206 and accompanying small particulate matter being forced through the well screen 114 correspondingly increases. Just prior to screen-out, the greatest volume, velocity, and pressure of the fluid 206, and any small particulate matter suspended therein, will be forced through the erosion resistant screen section 116, and thereby mitigating and otherwise preventing erosion effects of the fluid 206 on the well screen assembly 115.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

One or more illustrative embodiments disclosed herein are presented below. Not all features of an actual implementation are described or shown in this application for the sake of clarity. It is understood that in the development of an actual implementation incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill the art having benefit of this disclosure.

While compositions and methods are described herein in terms of "comprising" various components or steps, the compositions and methods can also "consist essentially of" or "consist of" the various components and steps. When "comprising" is used in a claim, it is open-ended. When "comprising" is used in the disclosure, it is open-ended.

Embodiments disclosed herein include:

A. An assembly, comprising: a production tubing having at least one flow port defined therein; a well screen arranged about the production tubing and in fluid communication with the at least one flow port; and an erosion resistant screen section arranged about the production tubing uphole from the well screen and in fluid communication with the at least one flow port.

B. A method, comprising: introducing a well screen assembly arranged on a production tubing into a wellbore, the production tubing having at least one flow port defined therein and the well screen assembly having at least one well screen arranged about the production tubing and an erosion resistant screen section arranged about the production tubing uphole from the well screen, wherein the at least one well screen and the erosion resistant screen section are in fluid communication with the at least one flow port; depositing a gravel slurry comprising a fluid and gravel into an annulus defined between the well screen assembly and the wellbore; flowing a portion of the fluid into the production tubing through the at least one well screen and the erosion resistant screen section as the gravel slurry is deposited in the annulus; progressively building a gravel pack within the annulus in an uphole direction as the gravel slurry is deposited into the annulus; increasing a velocity and a pressure of the portion of the fluid flowing through the at least one well screen and the erosion resistant screen section as the gravel pack is progressively built in the uphole direction; and flowing the portion of the fluid at a greatest velocity and pressure through the erosion resistant screen section prior to screen-out as the gravel pack is progressively built in the uphole direction.

Each of embodiments A and B may have one or more of the following additional elements in any combination:

Element 1: Further comprising an end ring arranged about the production tubing uphole from the erosion resistant screen section, the erosion resistant screen section being coupled to the end ring and extending axially downhole therefrom.

Element 2: Further comprising an end ring arranged about the production tubing uphole from the erosion resistant screen section, the erosion resistant screen section being coupled to the end ring and extending axially downhole therefrom, wherein the end ring extends over the at least one flow port.

Element 3: Wherein the well screen and the erosion resistant screen section are axially offset downhole from the at least one flow port.

Element 4: Wherein the well screen and the erosion resistant screen section are directly coupled to each other.

Element 5: Wherein the well screen and the erosion resistant screen section are coupled to each other with at least one of a shroud and a sleeve.

Element 6: Wherein the erosion resistant screen section is at least partially made of an erosion resistant material selected from the group consisting of a ceramic, a hardened metal, a carbide, a polymeric compound, and any combination thereof.

Element 7: Wherein the ceramic is selected from the group consisting of an oxide ceramic, a boride ceramic, a nitride ceramic, a silicate ceramic, a ceramic composite material, and any combination thereof.

Element 8: Wherein the oxide ceramic is selected from the group consisting of silicon oxide, silicon dioxide, aluminum oxide, aluminum titanate, beryllium oxide, zirconium oxide, magnesium oxide, titanium dioxide, lead zirconium titanate, and any combination thereof.

Element 9: Wherein the boride ceramic is selected from the group consisting of titanium diboride, zirconium diboride, hafnium diboride, and any combination thereof.

Element 10: Wherein the nitride ceramic is selected from the group consisting of silicon nitride, aluminum nitride, boron nitride, titanium nitride, zirconium nitride, vanadium nitride, niobium nitride, tantalum nitride, hafnium nitride, and any combination thereof.

Element 11: Wherein the silicate ceramic is selected from the group consisting of porcelain, steatite, cordierite, mullite, and any combination thereof.

Element 12: Wherein the hardened metal is hardened steel.

Element 13: Wherein the carbide is selected from the group consisting of silicon carbide, boron carbide, tungsten carbide, vanadium carbide, hafnium carbide, tantalum carbide, zirconium carbide, titanium carbide, niobium carbide, chromium carbide, molybdenum carbide, and any combination thereof.

Element 14: Wherein the polymeric compound is selected from the group consisting of a polyimide, a polyamide, a polyketone, a polyetherketone, a polysulfone, a polycarbonate, a polystyrene, a polyvinyl chloride, a polypropylene, a polyetherketone, a polyethersulfone, a polyethylene terephthalate, a polyethylene, a polyester, a polyesteramide, a polyvinyl formal, a polyvinyl alcohol, a polytetrafluoroethylene, a polyamine (e.g., a nylon), a polyacrylate (e.g., polymethylacrylate), a polyurethane, a fluoroethylene/propylene copolymer, a vinyl chloride/vinylidene chloride copolymer, a vinyl chloride/vinyl acetate copolymer, a butadiene/styrene copolymer, a cellulose, a triacetate, a silicone, a rubber, and any copolymers thereof, any terpolymers thereof, and any combination thereof.

By way of non-limiting example, exemplary combinations applicable to A and B include: A with 1, 2, and 14; A with 5 and 9; B with 4 and 14; B with 5 and 11.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. An assembly, comprising:

a production tubing configured to be introduced into a wellbore, the production tubing having a plurality of flow ports defined therein;

a plurality of well screens each arranged about the production tubing and in fluid communication with a respective flow port of the plurality of flow ports; and a single erosion resistant screen section arranged about the production tubing uphole from an uppermost well screen of the plurality of well screens and in fluid communication with an uppermost flow port of the plurality of flow ports.

2. The assembly of claim 1, further comprising an end ring arranged about the production tubing uphole from the erosion resistant screen section, the erosion resistant screen section being coupled to the end ring and extending axially downhole therefrom.

3. The assembly of claim 2, wherein the end ring extends over at least one flow port of the plurality of flow ports.

4. The assembly of claim 1, wherein the uppermost well screen and the erosion resistant screen section are axially offset downhole from the uppermost flow port.

5. The assembly of claim 1, wherein the uppermost well screen and the erosion resistant screen section are directly coupled to each other.

6. The assembly of claim 1, wherein the uppermost well screen and the erosion resistant screen section are coupled to each other with at least one of a shroud and a sleeve.

7. The assembly of claim 1, wherein the erosion resistant screen section is at least partially made of an erosion resistant material selected from the group consisting of a ceramic, a hardened metal, a carbide, a polymeric compound, and any combination thereof.

8. The assembly of claim 7, wherein the ceramic is selected from the group consisting of an oxide ceramic, a boride ceramic, a nitride ceramic, a silicate ceramic, a ceramic composite material, and any combination thereof.

9. The assembly of claim 8, wherein the oxide ceramic is selected from the group consisting of silicon oxide, silicon dioxide, aluminum oxide, aluminum titanate, beryllium oxide, zirconium oxide, magnesium oxide, titanium dioxide, lead zirconium titanate, and any combination thereof.

10. The assembly of claim 8, wherein the boride ceramic is selected from the group consisting of titanium diboride, zirconium diboride, hafnium diboride, and any combination thereof.

11. The assembly of claim 8, wherein the nitride ceramic is selected from the group consisting of silicon nitride, aluminum nitride, boron nitride, titanium nitride, zirconium nitride, vanadium nitride, niobium nitride, tantalum nitride, hafnium nitride, and any combination thereof.

12. The assembly of claim 8, wherein the silicate ceramic is selected from the group consisting of porcelain, steatite, cordierite, mullite, and any combination thereof.

13. The assembly of claim 7, wherein the hardened metal is hardened steel.

14. The assembly of claim 7, wherein the carbide is selected from the group consisting of silicon carbide, boron carbide, tungsten carbide, vanadium carbide, hafnium carbide, tantalum carbide, zirconium carbide, titanium carbide, niobium carbide, chromium carbide, molybdenum carbide, and any combination thereof.

15. The assembly of claim 7, wherein the polymeric compound is selected from the group consisting of a polyimide, a polyamide, a polyketone, a polyetherketone, a polysulfone, a polycarbonate, a polystyrene, a polyvinyl chloride, a polypropylene, a polyetherketone, a polyethersulfone, a polyethylene terephthalate, a polyethylene, a polyester, a polyesteramide, a polyvinyl formal, a polyvinyl alcohol, a polytetrafluoroethylene, a polyamine (e.g., a nylon), a polyacrylate (e.g., polymethylacrylate), a polyurethane, a fluoroethylene/propylene copolymer, a vinyl chloride/vinylidene chloride copolymer, a vinyl chloride/vinyl acetate copolymer, a butadiene/styrene copolymer, a cellulose, a triacetate, a silicone, a rubber, and any copolymers thereof, any terpolymers thereof, and any combination thereof.

16. A method, comprising:

introducing a well screen assembly arranged on a production tubing into a wellbore, the production tubing having a plurality of flow ports defined therein and the well screen assembly having a plurality of well screens each arranged about the production tubing and a single erosion resistant screen section arranged about the production tubing uphole from an uppermost well screen of the plurality of well screens, wherein the plurality of well screens are in fluid communication with a respective flow port of the plurality of flow ports and the erosion resistant screen section is in fluid communication with an uppermost flow port of the plurality of flow ports;

depositing a gravel slurry comprising a fluid and gravel into an annulus defined between the well screen assembly and the wellbore;

flowing a portion of the fluid into the production tubing through the plurality of well screens and the erosion resistant screen section as the gravel slurry is deposited in the annulus;

progressively building a gravel pack within the annulus in an uphole direction as the gravel slurry is deposited into the annulus;

increasing a velocity and a pressure of the portion of the fluid flowing through the plurality of well screens and the erosion resistant screen section as the gravel pack is progressively built in the uphole direction; and flowing the portion of the fluid at a greatest velocity and pressure through the erosion resistant screen section prior to screen-out as the gravel pack is progressively built in the uphole direction.

17. The method of claim 16, further comprising arranging an end ring about the production tubing uphole from the erosion resistant screen section, the erosion resistant screen section being coupled to the end ring and extending axially downhole therefrom.

18. The method of claim 17, further comprising extending the end ring over at least one flow port of the plurality of flow ports.

19. The method of claim 16, further comprising axially offsetting the uppermost well screen and the erosion resistant screen section downhole from the uppermost flow port.

20. The method of claim 16, further comprising directly coupling the uppermost well screen and the erosion resistant screen section to each other.

21. The method of claim 16, further comprising coupling the uppermost well screen and the erosion resistant screen section together to each other with at least one of a shroud and a sleeve.

22. The method of claim 16, wherein the erosion resistant screen section is at least partially made of an erosion resistant material selected from the group consisting of a ceramic, a hardened metal, a carbide, a polymeric compound, and any combination thereof.

* * * * *